US008820827B2

(12) United States Patent
Olarte

(10) Patent No.: US 8,820,827 B2
(45) Date of Patent: Sep. 2, 2014

(54) REMOVABLE SEATING SYSTEM

(75) Inventor: Alvaro Mauricio Olarte, Aventura, FL (US)

(73) Assignee: Series International LLC, Aventura, FL (US)

( * ) Notice: Subject to any disclaimer, the term of this patent is extended or adjusted under 35 U.S.C. 154(b) by 539 days.

(21) Appl. No.: 13/088,130

(22) Filed: Apr. 15, 2011

(65) Prior Publication Data

US 2012/0261971 A1 Oct. 18, 2012

(51) Int. Cl.
*A47C 13/00* (2006.01)
*A47C 7/00* (2006.01)
*A47B 91/08* (2006.01)

(52) U.S. Cl.
CPC ..... *A47C 7/002* (2013.01); *A47C 7/006* (2013.01)
USPC ..... 297/130; 297/440.1

(58) Field of Classification Search
USPC ..... 297/130, 217.7, 440.1; 248/501, 129, 248/222.11, 221.12, 222.41
See application file for complete search history.

(56) References Cited

U.S. PATENT DOCUMENTS 3,528,096 A * 9/1970 Moberg ..... 297/130
3,877,674 A 4/1975 Cerutti
4,114,947 A * 9/1978 Nelson ..... 297/344.1
4,725,027 A * 2/1988 Bekanich ..... 248/125.8
4,754,943 A 7/1988 Froutzis
4,789,126 A 12/1988 Rice et al.
4,828,208 A 5/1989 Peterson et al.
4,955,575 A * 9/1990 Moore ..... 248/398
5,020,286 A 6/1991 Hamar et al.
5,121,891 A 6/1992 Goldsmith
5,236,165 A 8/1993 Conway
5,383,644 A 1/1995 Huse
5,549,072 A 8/1996 Maloney
5,762,296 A * 6/1998 Gilbert ..... 244/118.1
5,826,850 A * 10/1998 Goldsmith ..... 248/415
5,944,388 A * 8/1999 Saucier et al. ..... 297/440.1
6,116,183 A * 9/2000 Crow et al. ..... 114/363
6,145,912 A 11/2000 Rice et al.
6,428,100 B1 * 8/2002 Kain et al. ..... 297/256.16
6,554,353 B1 4/2003 Yu (Continued)

OTHER PUBLICATIONS

International Search Report and Written Opinion of the International Searching Authority; Application No. PCT/US2012/033494; Issued: Jun. 27, 2012; Mailing Date: Jul. 11, 2012; 11 pages.

*Primary Examiner* — David R Dunn
*Assistant Examiner* — Tania Abraham
(74) *Attorney, Agent, or Firm* — St. Onge Steward Johnston & Reens LLC

(57) ABSTRACT

A removable seating system includes a mounting receptacle, a seat, and a retractable coupling device coupled to the seat. The retractable coupling device couples the seat to the mounting receptacle when inserted into the mounting receptacle. The retractable coupling device disengages the seat from the mounting receptacle when retracted from the mounting receptacle. The retractable coupling device retracts into the seat when the seat is disengaged from the mounting receptacle. The system further includes a mounting face in the mounting receptacle and a mounting slot in the mounting face. The retractable coupling device includes a rotating bolt that couples the seat to the mounting receptacle by entering the mounting slot, rotating, and engaging the underside of the mounting face. The rotating bolt disengages the seat from the mounting receptacle by rotating so as to become aligned with the mounting slot and retracting from the mounting slot and into the seat.

33 Claims, 18 Drawing Sheets

(56) References Cited

U.S. PATENT DOCUMENTS 6,805,394 B2 * 10/2004 Kettler et al. ..... 296/65.05
7,594,696 B2 * 9/2009 Girard ..... 297/195.11
2005/0194823 A1 * 9/2005 Perry et al. ..... 297/130
2006/0202536 A1 9/2006 Luchetti et al.
2007/0216205 A1 * 9/2007 Davis ..... 297/241
2010/0171345 A1 7/2010 Powell et al.

* cited by examiner 100
120
150
310
300
110
130
300
330
320

REMOVABLE SEATING SYSTEM

FIELD OF THE INVENTION

The apparatus described herein generally relates to the field of seating, and more specifically, to the field of removable venue seating.

BACKGROUND OF THE INVENTION

Entertainment and hosting venues often have seating for audiences attending performances. Venue seating should maximize seating capacity for a given amount of floor area while remaining comfortable and safe for guests. The seating should also be installed in a manner that permits foot-traffic of guests within rows for their convenience, comfort, and safety. Some venue seating must be configured to be handicapped-accessible. Venue seating tends to be sturdily constructed because of the heavy use and long service life it must typically endure. Venue seating must also be sturdily constructed to withstand indifferent treatment by patrons and ensure patron safety.

Typical venue seating is configured in modular rows of several seats—several of these rows are used to fill the venue with seating. These and other common venue seating systems are "permanently" installed; meaning that although they can be removed and reinstalled, doing so is time and labor intensive. For this type of setup, removal and reinstallation of the seating is impractical for a single event, or even a series of events over a short period. Furthermore, it may be difficult to arrange modular rows of seating in a way that maximizes seating capacity for a particular venue. For example, it may be difficult to achieve curved rows with this type of seating system.

Sometimes it is desirable to remove seating from a venue for a performance or event that is better suited for a bare floor (angled, flat, or tiered). For example, if the owner of a medium-sized performing arts theater with permanent seating has an opportunity to host a big-ticket rock concert, the owner cannot convert the floor-space into a bare floor to maximize ticket sales. Thus, the owner of that venue would probably have to decline such an event opportunity for inability to generate sufficient revenue for the performers. In another example, a place of worship may want to host a dance event for its congregation in its normal worship space; removable seating would be necessary to accommodate this event. Situations like this could be significant factors affecting the revenue generating potential and versatility of a venue.

Portable chairs, particularly if they are designed to be stackable, address many of the issues raised above. However, stackable chairs are almost invariably uncomfortable and lack a professional appearance. Furthermore, they are typically not as rugged as permanent seating installations. They also tend to be less space efficient, because the chairs may not be shaped for efficient abutment. This is especially true where curved rows of seats are desired. Even if an efficient seating arrangement is achieved, the chairs will quickly shift out of position and the arrangement will waste more space over time. The migration of the chairs may also affect foot-traffic and handicapped mobility as the rows become deformed, crooked, and narrow in portions. In order to overcome these problems, the chairs must be regularly rearranged—perhaps before every event. The movement of the chairs may damage the floor and the chairs over an extended period.

Chairs are also less safe and more likely to be stolen due to their mobility. Because they are often less sturdily built, they are more likely to collapse after extended use or if overloaded. In the event of a fire or mass panic, many of the chairs could be knocked over resulting in unwanted obstructions and additional injuries. The additional obstruction caused by the chairs may induce or worsen a stampede. A seating system with permanent seating is highly preferable for most entertainment venues, particularly for safety reasons.

What is desired is a venue seating system that maximizes the versatility of a venue in which it is installed, while retaining the comfort, safety, and professional appearance of permanent venue seating. To accomplish this end, the seating must be easily removed and installed. Specifically, each seat should be capable of being installed and removed in a very short period of time by a single individual or small group of people without the use of tools. What is even more desirable is a system where the seats are fungible and do not have to be reinstalled in the same location from where they were removed. This is especially crucial given the raw number of seats that must be removed and installed, and the short amount of time a venue may have to convert its seating arrangement.

The seating system must be sufficiently rugged for the demands of venue seating. Although the seating must be easy to remove intentionally, it must be difficult to remove accidentally for guest safety. It is also preferable for the method of removal not to be immediately obvious to (and preferably go unnoticed by) a majority of the venue patrons. Furthermore, the seating must be convenient to transport and store once removed from the venue. It would also be desirable for the seating to be capable of functioning as seats when removed from the venue. It would also be desirable to have a removable seating system that minimizes damage to the floor they are mounted on, both during use and during temporary installation/removal. Finally, it is important, particularly when a dance floor is desired, to leave a very smooth, finished floor without residual mounting hardware protruding from the surface when the seating is temporarily removed.

SUMMARY OF THE INVENTION

A removable seating system includes a mounting receptacle, a seat, and a retractable coupling device coupled to the seat. The retractable coupling device couples the seat to the mounting receptacle when inserted into the mounting receptacle. The retractable coupling device disengages the seat from the mounting receptacle when retracted from the mounting receptacle. The retractable coupling device retracts into the seat when the seat is disengaged from the mounting receptacle. The system further includes a mounting face in the mounting receptacle and a mounting slot in the mounting face. The retractable coupling device includes a rotating bolt that couples the seat to the mounting receptacle by entering the mounting slot, rotating, and engaging the underside of the mounting face. The rotating bolt disengages the seat from the mounting receptacle by rotating so as to become aligned with the mounting slot and retracting from the mounting slot and into the seat.

DETAILED DESCRIPTION OF THE INVENTION

Figure 1:
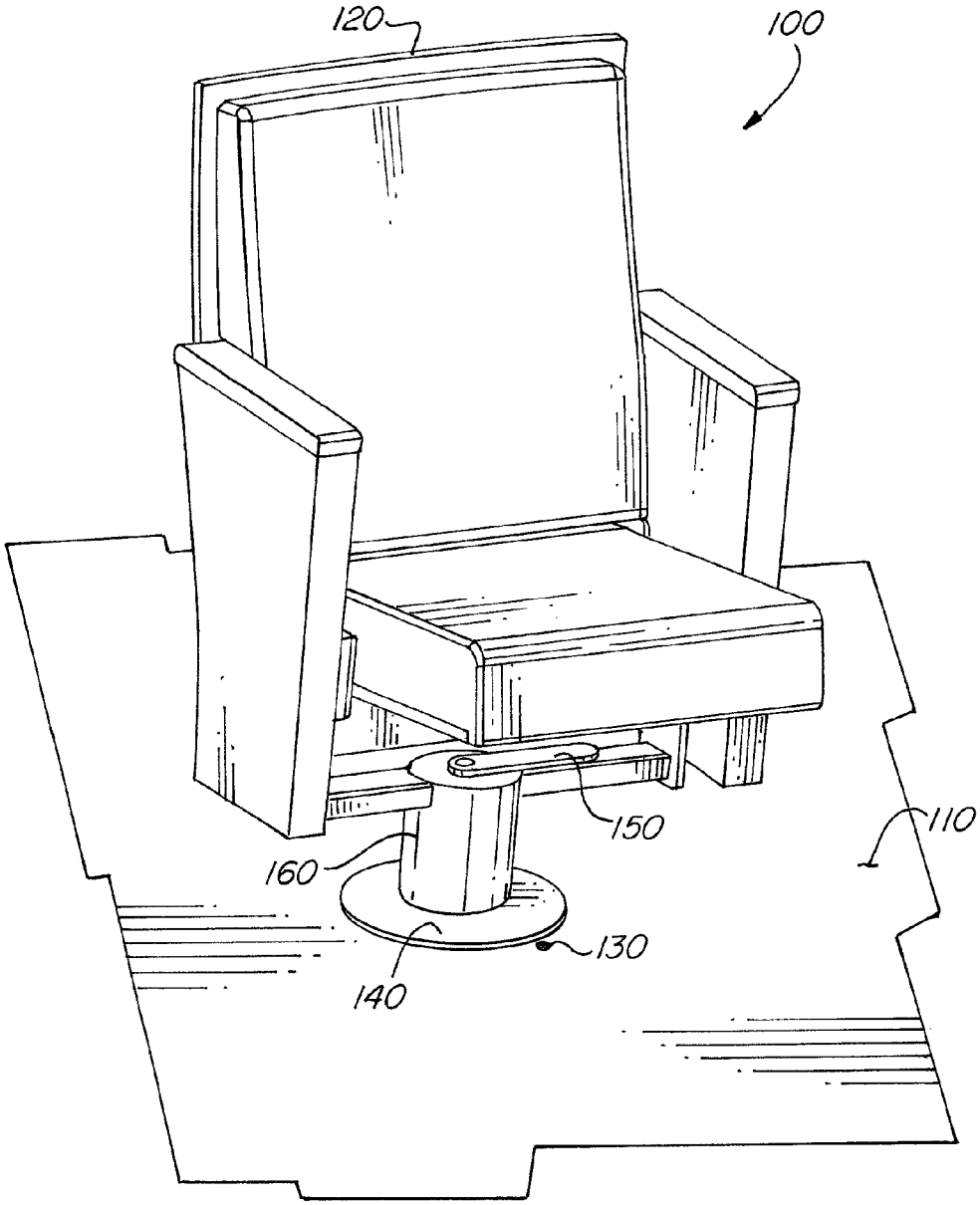
FIG. 1 is an isometric view of a seating system according to one embodiment in a mounted configuration.

FIG. 1 shows the seating system 100 according to one embodiment in a mounted configuration. Seating system 100 comprises a seat 120, a mounting system, and a floor 110. Seat 120 features selector 150 which is used to selectively mount seat 120 to floor 110. Seat 120 also features a base flange 140 for providing structural support and rigidity to the coupling between floor 110 and seat 120. Base flange 140 provides support for seat 120 when seat 120 is mounted to floor 110, because it engages floor 110 over a broad area. This allows for a wider contact between seat 120 and floor 110 which makes seat 120 less prone to tipping in any direction relative to floor 110. Furthermore, base flange 140 prevents damage to floor 110 by spreading the load of seat 120 over a wider area on floor 110. Base flange 140 is aligned with alignment guide 130 when seat 120 is mounted to floor 110. In FIG. 1, selector 150 is in a sideways position which corresponds to seat 120 being mounted to floor 110.

FIG. 1 shows the normal, installed configuration for seat 120. Thus, this is the configuration that would be encountered by patrons to the venue in which seat 120 was installed. FIG. 1 also features the seat 120 with the pivoting lower seat in a lowered position. This position facilitates a seated patron. It should be noted here that the selector 150 is relatively inconspicuous in its mounted, sideways position. Thus, it is unlikely that the typical patron will notice the selector 150 or infer its purpose.

Figure 2:
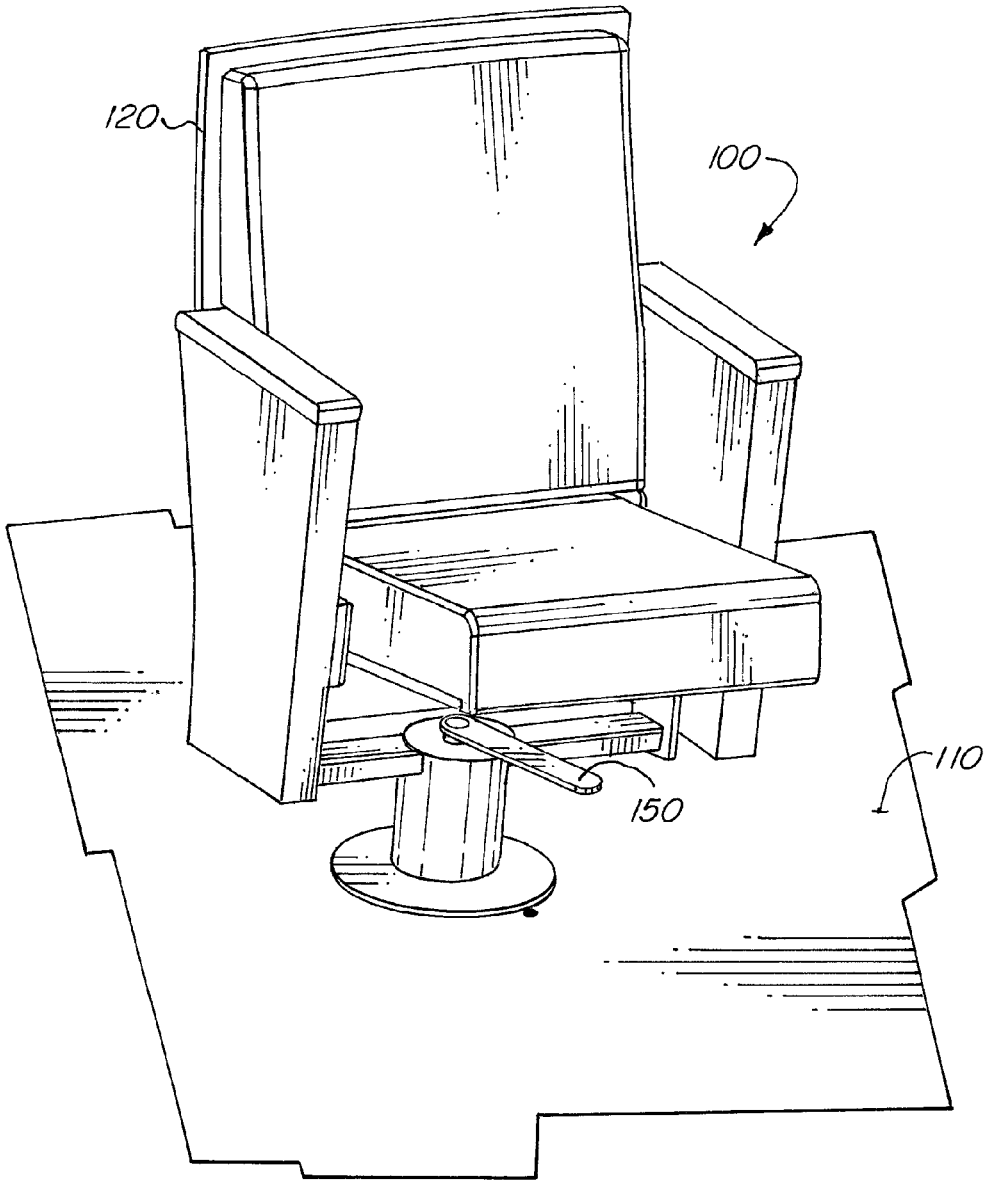
FIG. 2 is an isometric view of the seating system of FIG. 1 in a resting configuration.

FIG. 2 is seating system 100 with seat 120 in a resting configuration. Selector 150 is oriented in a forward position which corresponds to seat 120 being mounted to floor 110.

Figure 3:
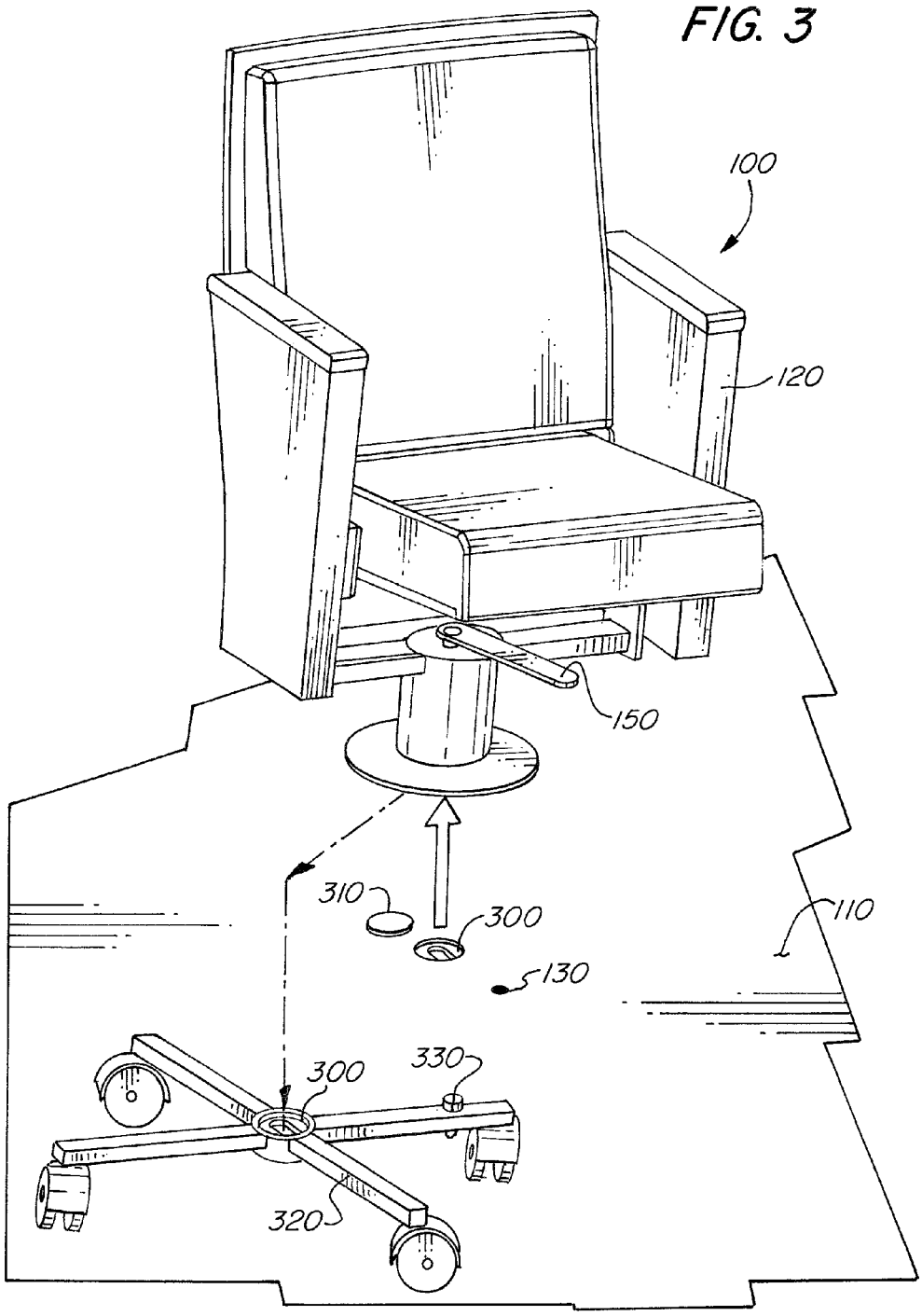
FIG. 3 is a partially schematic isometric view of the seating system of FIG. 1 in a dismounted configuration with a stand in the foreground.
Figure 4:
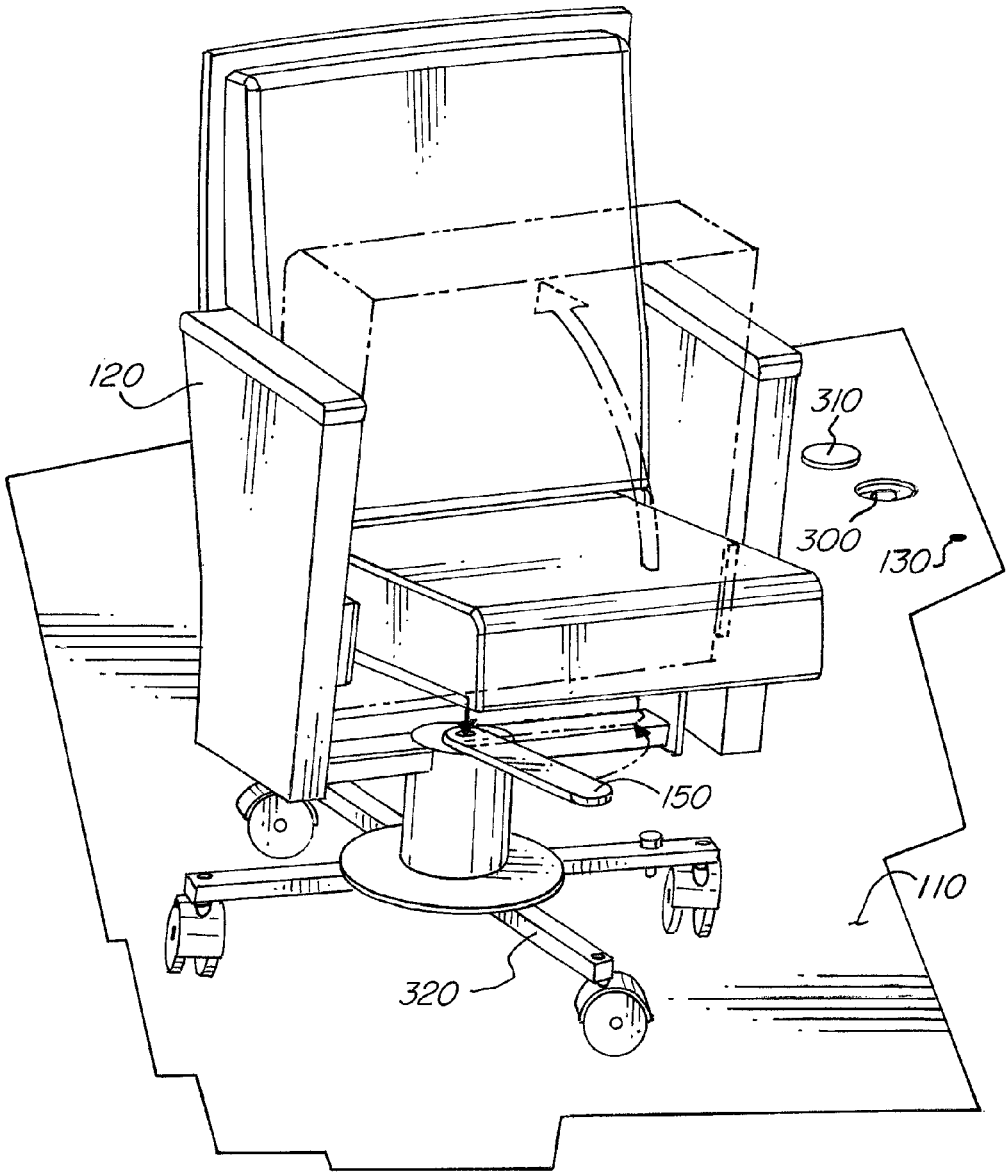
FIG. 4 is a partially schematic isometric view of the seating system of FIG. 1 is resting on a stand.

FIG. 3 is seating system 100 with seat 120 in a dismounted configuration and further includes a stand 320 in the foreground. FIG. 4 shows seat 120 resting on stand 320. As demonstrated in FIG. 4, the pivoting lower seat may assume a raised position, when not in use, to broaden walkways between rows of seats (when mounted to floor 110) or to reduce the seat's size for storage (when mounted to stand 320). Seat 120 is in the dismounted configuration and has been lifted off of floor 110. This removes the coupling device on seat 120 from the mounting receptacle 300 located on floor 110. Seat 120 is then moved onto stand 320. In this embodiment, stand 320 has cover holder 330 that holds receptacle cover 310 when not in use. Receptacle cover 310 is used to cover mounting receptacle 300 when seat 120 is not mounted thereon. This leaves a smooth, finished floor surface when seat 120 is removed. Having a smooth, finished floor surface is advantageous for safety, functional, and aesthetic reasons. This is especially true where a dance floor is desired once the seating is removed. In this embodiment, cover holder 330 comprises a magnet and receptacle cover 310 is comprises a magnetic material. Thus, receptacle cover 310 is held onto cover holder 330 by magnetic force.

Figure 5:
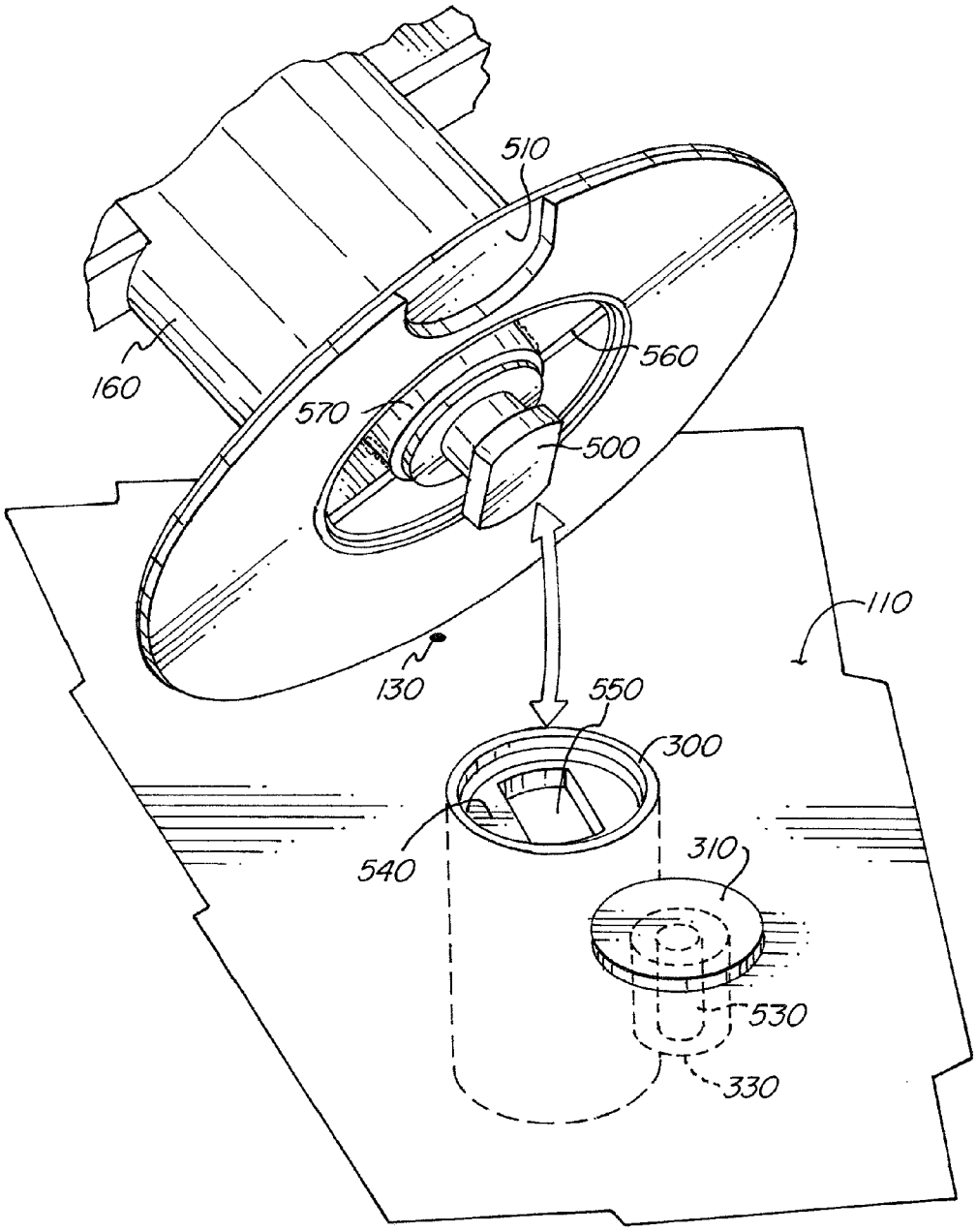
FIG. 5 is a partially schematic isometric blown-up view of one embodiment of the coupling hardware on the seat and the mounting hardware on the floor of the seating system of FIG. 1.

FIG. 5 shows the coupling hardware on seat 120 and the mounting hardware on floor 110 in seating system 100. In this embodiment, cover holder 330 comprises a hole in floor 110. Receptacle cover 310 comprises cover dowel 530 that is inserted into cover holder 330 for storage. Cover holder 330 is located in floor 110 such that receptacle cover 310 occupies a portion of the area of floor 110 covered by base flange 140. Receptacle cover 310 protrudes from floor 110 when stowed in cover holder 330. Thus, base flange 140 comprises cover slot 510 to provide clearance for receptacle cover 310 when both seat 120 and receptacle cover 310 are mounted to floor 110.

The coupling device comprises a rotating bolt 500. Rotating bolt 500 is inserted into mounting receptacle 300 to couple seat 120 to floor 110. In this embodiment, the coupling device comprises rotating bolt 500 and mounting receptacle 300 comprises a mounting face 540 and a mounting slot 550. Rotating bolt 500 is inserted into mounting slot 550 and rotated such that rotating bolt 500 engages mounting face 540 and holds seat 120 to floor 110. Alignment guide 130 allows a user to line up rotating bolt 500 with mounting slot 550. When a user visually aligns alignment guide 130 with the front of base flange 140, this results in rotating bolt 500 being aligned with mounting slot 550.

Buttresses 560 are welded to lower guide 570 and pedestal 160 and provide a brace therebetween. Buttresses 560 provide structural support to the coupling device. This ensures that the seat does not flex when torque is applied along the axis of the coupling mechanism. Buttresses 560 also allow the seat's loads to be transferred from the coupling device and base flange 140, and vice versa. Thus, buttresses 560 result in a stronger seat and a stronger coupling between seat 120 and floor 110.

Figure 6:
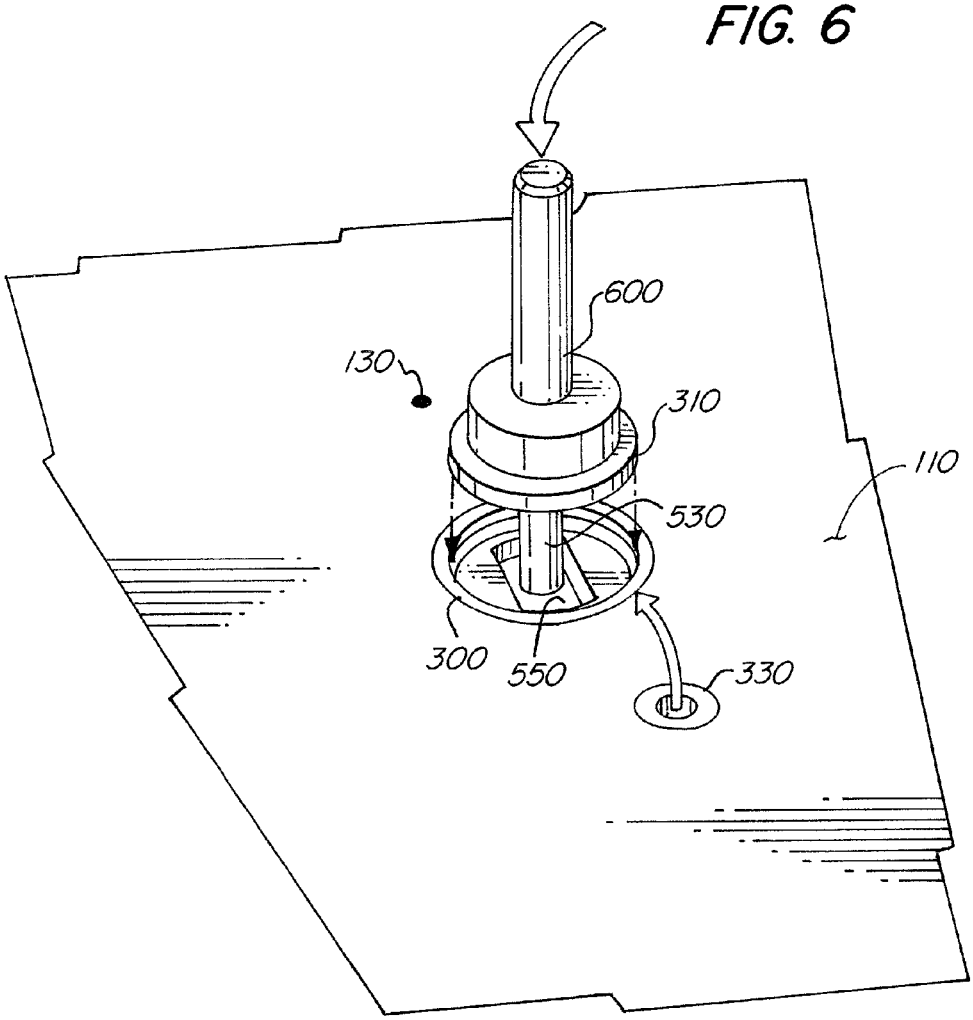
FIG. 6 is a partially schematic isometric blown-up view of the mounting hardware on the floor from the seating system of FIG. 1.

FIG. 6 shows mounting hardware on floor 110 in seating system 100. In this embodiment, cover holder 330 is a bore in floor 110. Receptacle cover 310 also comprises cover dowel 530 which allows it to engage mounting slot 550 in mounting receptacle 300 and cover holder 330. Cover extractor 600 comprises a magnet and a dowel. A user grasps the dowel and couples the magnet to receptacle cover 310, which comprises a magnetic material. The user then lifts cover extractor 600 and receptacle cover 310, engages cover dowel 530 in cover holder 330, and decouples cover extractor 600 from receptacle cover 310 to stow receptacle cover 310. Cover extractor 600 may be stored on stand 320.

Figure 7:
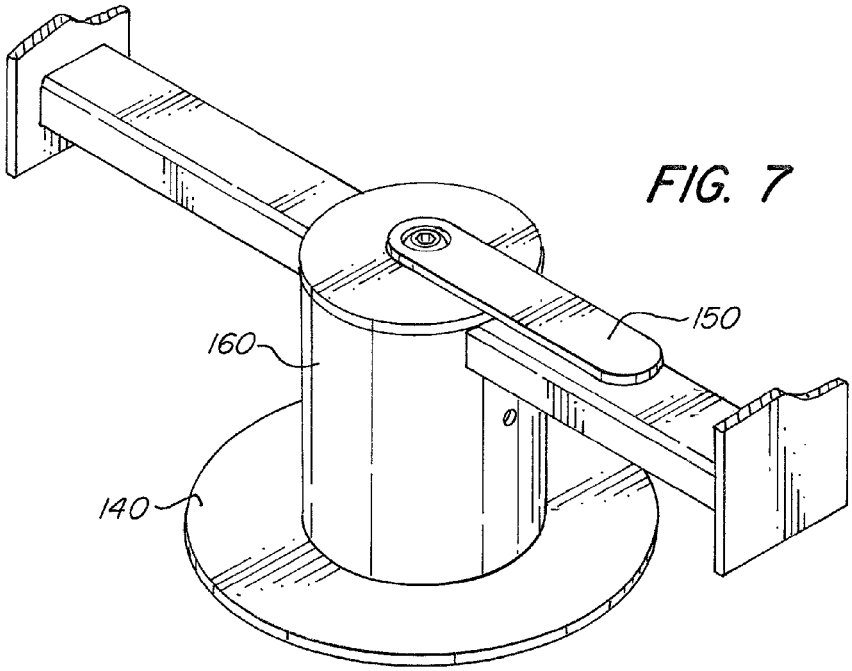
FIG. 7 is an isometric view of the pedestal of the chair from the seating system of FIG. 1 in a mounted configuration.
Figure 8:
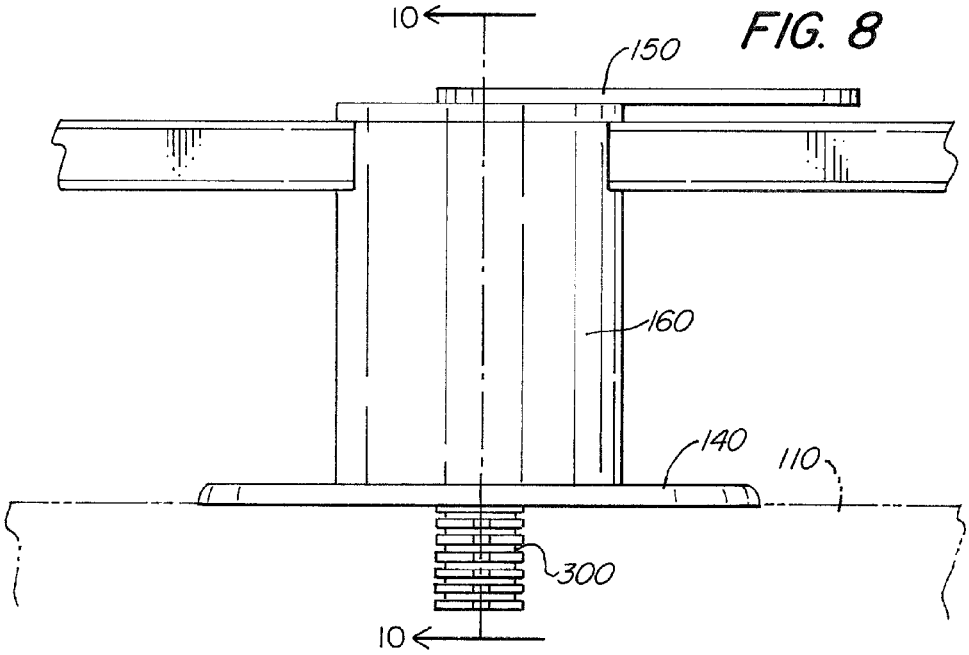
FIG. 8 is a front view of the pedestal of the chair from the seating system of FIG. 1 in a mounted configuration.

FIGS. 7 and 8 show pedestal 160 of seat 120 from seating system 100. Pedestal 160 comprises the coupling device and mounting hardware that mounts seat 120 to floor 110.

Figure 9:
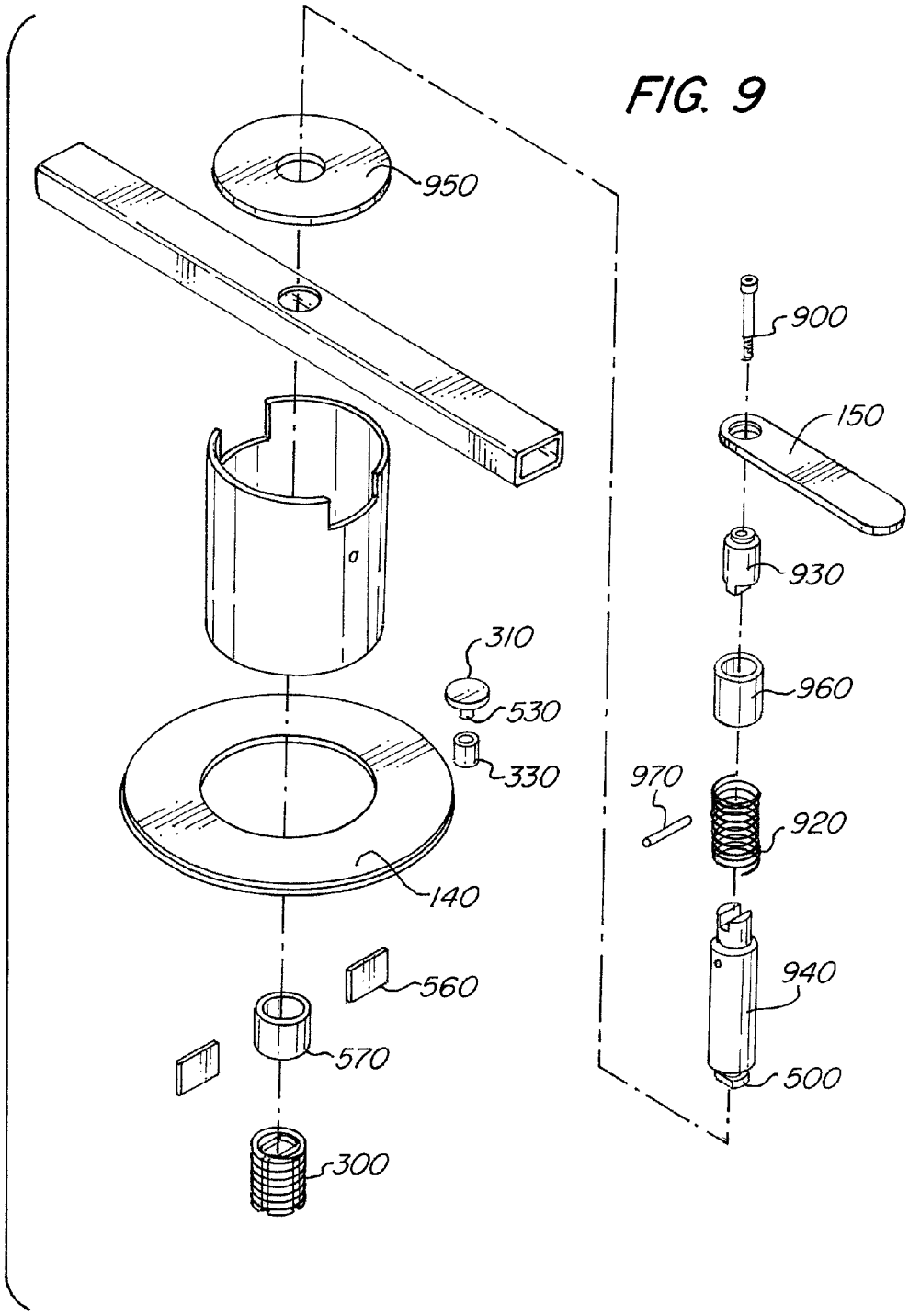
FIG. 9 is an isometric view of the disassembled coupling device and pedestal of the chair from the system of FIG. 1.

FIG. 9 shows the disassembled coupling device, seat pedestal 160, and mounting receptacle 300. Seat 120 comprises height adjuster 900 that adjusts the separation between upper linkage 930 and lower linkage 940. This adjusts the length of the coupling linkage; thereby adjusting the separation between seat 120 and mounting receptacle 300 when seat 120 is mounted thereon. Height adjuster 900 can also ensure a snug coupling between seat 120 and floor 110. Height adjuster 900 is a bolt with a hex head in this embodiment. The hex head is exposed and flush with selector 150, so that a user can easily access it. The user rotates height adjuster 900 by inserting a hex key and rotating. This allows a user to easily adjust the height of seat 120 relative to floor 110.

Figure 10:
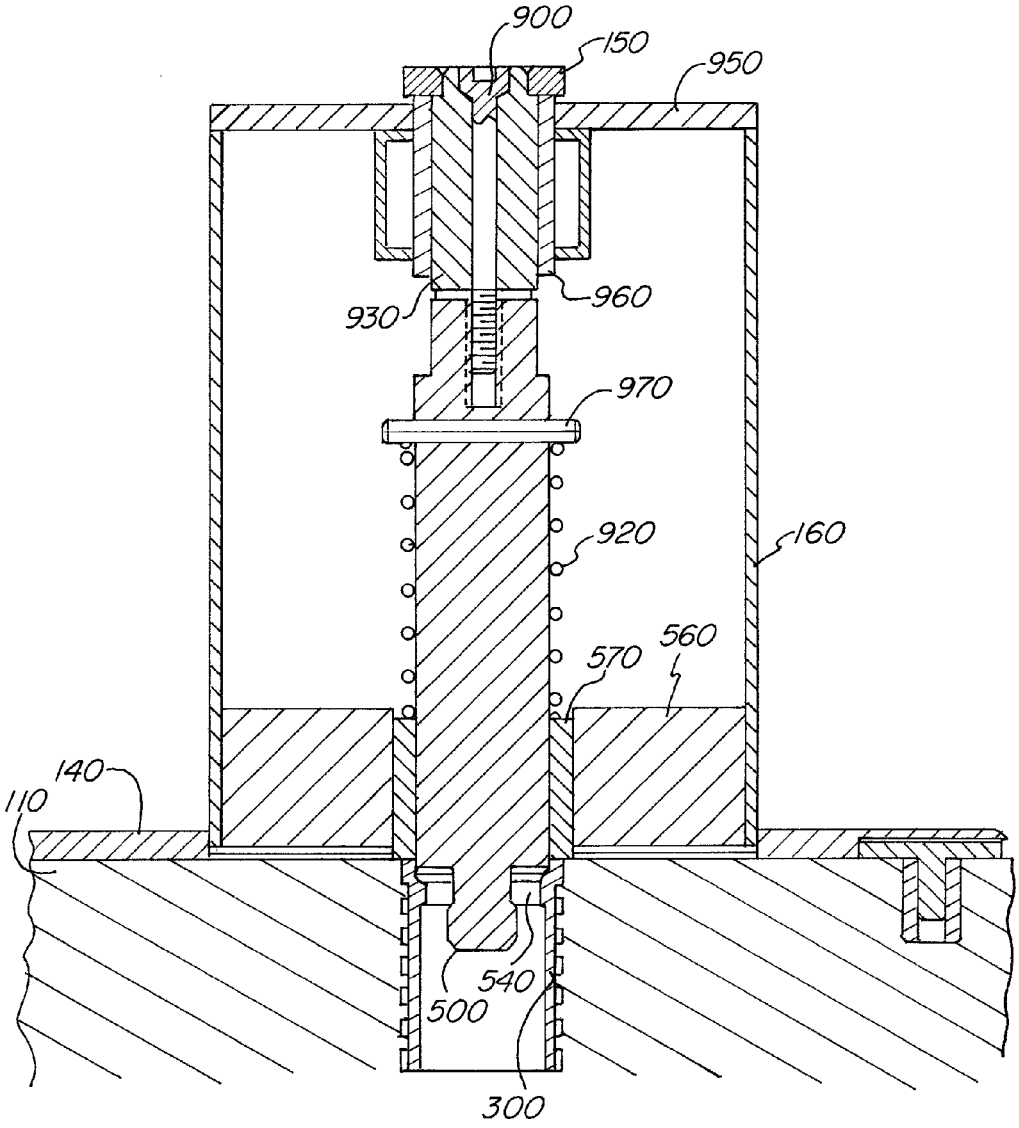
FIG. 10 is a cross-section view of the coupling mechanism and base of the chair, along line X from FIG. 9, from the system of FIG. 1.

FIG. 10 is a cross-section view of coupling device, chair pedestal 160, and mounting receptacle 300. As height adjuster 900 is rotated, the threads thereon cause upper linkage 930 and lower linkage 940 to either separate or merge. Because height adjuster 900 is a threaded bolt being adjusted by a hex key, it is capable of precise height adjustment. This separation is maintained once set by a user. Lower linkage 940 is coupled to spring brace 970. Retractor spring 920 surrounds lower linkage 940 and applies force between spring brace 970 and lower guide 570. The coupling device comprises height adjuster 900, upper linkage 930, lower linkage 940, rotating bolt 500, and spring brace 970.

When rotating bolt 500 is rotated such that it no longer engages mounting receptacle 300, lower linkage 940 is forced upward, retracting rotating bolt 500 into pedestal 160. Once rotating bolt 500 is retracted into pedestal 160, the bottom of pedestal 160 has a smooth, flat surface that engages floor 110. This allows a user to slide seat 120 on floor 110 once seat 120 has been dismounted from mounting receptacle 300. Sliding seat 120 over floor 110 does not damage floor 110 because bottom of pedestal 160 has a smooth, flat surface. Preferably, only base flange 140 is in contact with floor 110 once rotating bolt 500 is retracted.

Because base flange 140 has a wide diameter, the seat can be slid across floor 110 while remaining stable and not tipping or falling. The wide diameter of base flange 140 also prevents damage to floor 110 by spreading the weight of seat 120 over a broad area of floor 110. It is also advantageous for a user that seat 120 is in a stable condition resting on the floor 110 while dismounted because the user can leave seat 120 standing on floor 110 and attend to other tasks involved in removing seat 120. For example, the user may retract rotating bolt 500, slide seat 120 off of mounting receptacle 300, temporarily leave seat 120 in a standing position, and place receptacle cover 310 into mounting receptacle 300. A user working alone has the option of performing this task, or any other two-handed task, while seat 120 is not mounted to floor 110 or stand 320. Allowing the user flexibility in the manner of seat removal and assembly can speed up the process for each individual user. Furthermore, if a user becomes distracted while seat 120 is dismounted, seat 120 is automatically in a stable standing condition and will not automatically fall over, potentially damaging seat 120 and floor 110.

Figure 11:
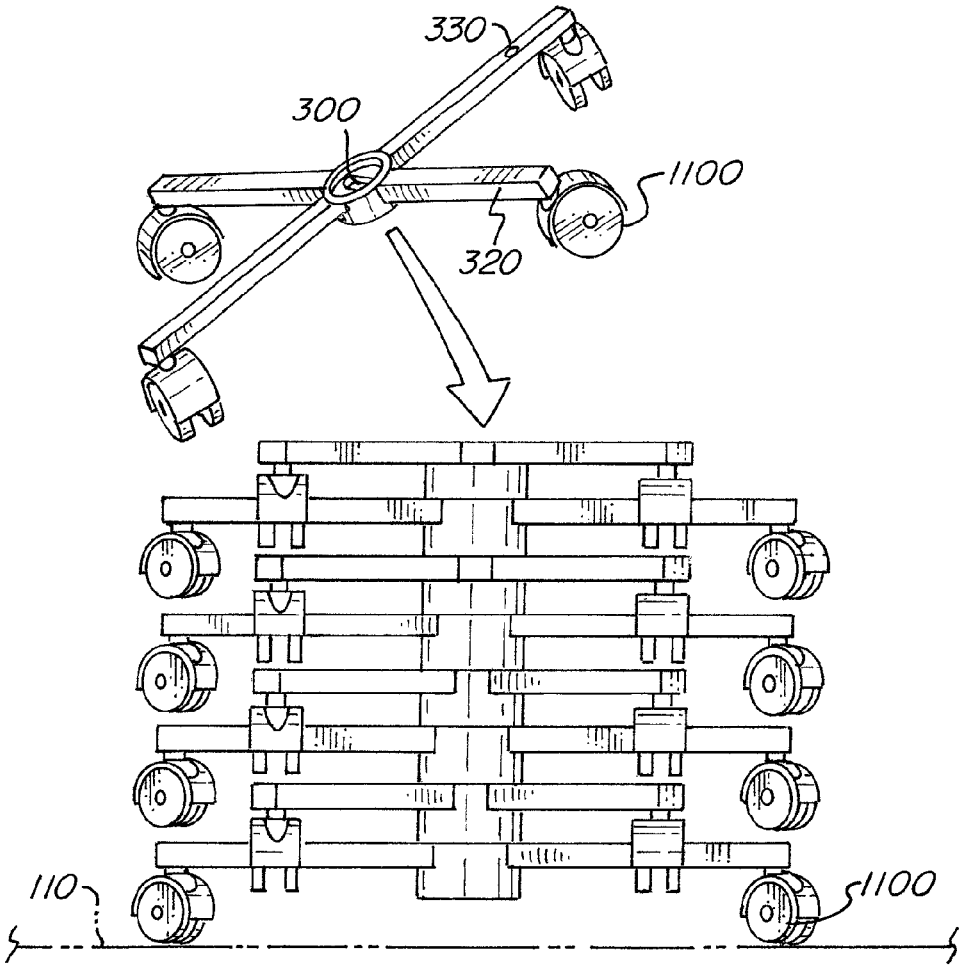
FIG. 11 is an isometric view of a stack of stands from the system of FIG. 1.

FIG. 11 shows a stack of stands for use with seating system 100. As shown in FIG. 3, seat 120 can be coupled to stand 320 once removed from floor 110. This allows for easy transport and use of seat 120, because stand 320 comprises wheels 1100. Once seat 120 is mounted to stand 320, seat 120 can function as a conventional rolling chair. Stand 320 comprises mounting receptacle 300 that is similar to mounting receptacle 300 in floor 110. Thus, seat 120 is mounted to stand 320 in the same manner as seat 120 is mounted to floor 110. Stand 320 also comprises cover holder 330 which is used to stow receptacle cover 310. Therefore, when a user removed seat 120 from floor 110, a receptacle cover 310 is conveniently available for installation on mounting receptacle 300 in floor 110. As can be seen in FIG. 11, stand 320 is easily stackable with other stands 320. Stands 320 are mounted by mating the mounting receptacles 300 on each stand. This allows for convenient storage and transportation of stands 320, especially because the lowest stand 320 on the stack will have a set of wheels 1100, which allows the entire stack to be rolled.

Figure 12:
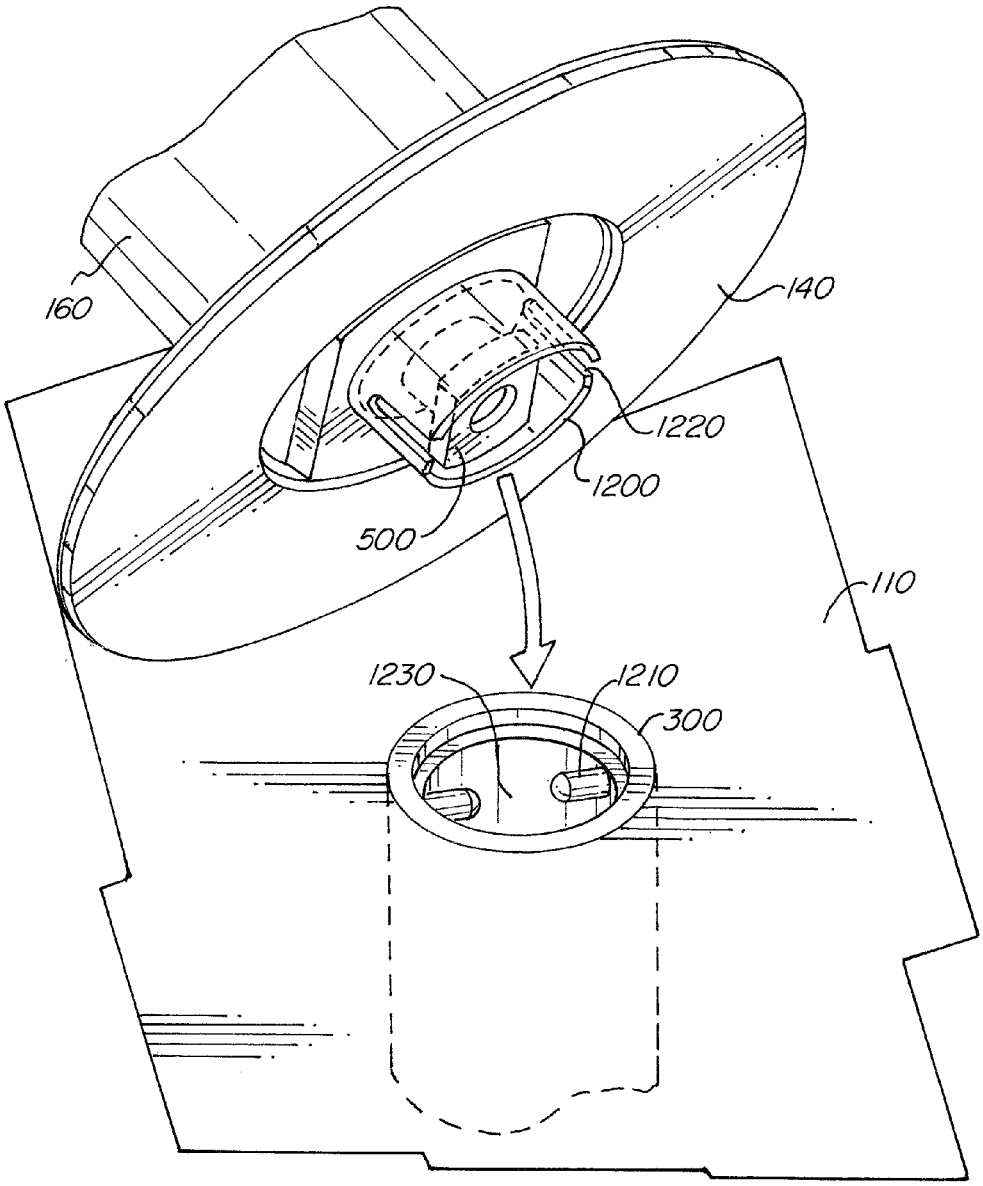
FIG. 12 is a partially schematic isometric blown-up view of one embodiment of the coupling device on the seat and the mounting hardware on the floor for use with the seating system of FIG. 1.
Figure 13:
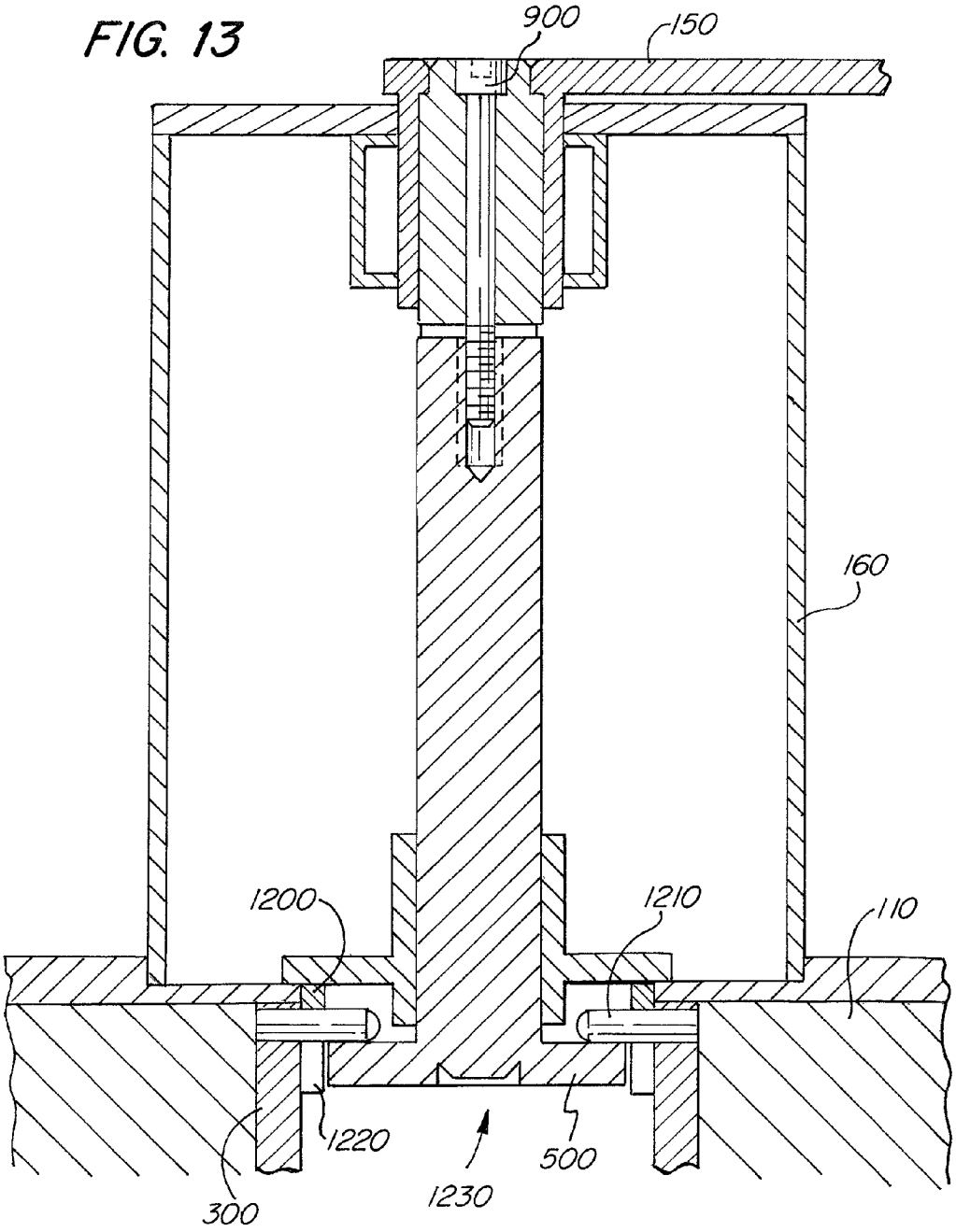
FIG. 13 is a cross-section view of one embodiment of the coupling device and pedestal of the chair for use with the system of FIG. 1.

FIGS. 12 and 13 show one embodiment of the coupling hardware on seat 120 and mounting receptacle 300 on floor 110. In this embodiment seat 120 comprises a sleeve 1200 comprising alignment slots 1220. Mounting receptacle 300 comprises a void 1230 and studs 1210. Sleeve 1200 is inserted into void 1230 in such a way that alignment slots 1220 engage studs 1210. Rotating bolt 500 rotates and engages studs 1210, as shown in FIG. 13. This couples seat 120 to floor 110. The engagement of both alignment slots 1220 and rotating bolt 500 create a very sturdy coupling between seat 120 and mounting receptacle 300. Alignment guide 130 allows a user to line up sleeve 1200 with void 1230 and align alignment slots 1220 with studs 1210. When a user visually aligns alignment guide 130 with the front of base flange 140, this results in proper alignment between the coupling device and mounting receptacle 300.

Sleeve 1200 has an outer dimension which matches the inner dimension of the void in mounting receptacle 300. This creates a snug fit which provides mechanical support between mounting receptacle 300 and seat 120. Thus, the coupling system of this embodiment is capable of supporting the seat with little, if any, additional buttressing. This type of coupling system may be advantageous for heavier seats or heavy duty applications. This embodiment also has the advantage of making it nearly impossible for a user to inadvertently install seat 120 in the wrong position—alignment slots 1220 and studs 1210 only engage in two possible positions (with seat 120 facing forward in the correct position or completely backward).

Figure 14:
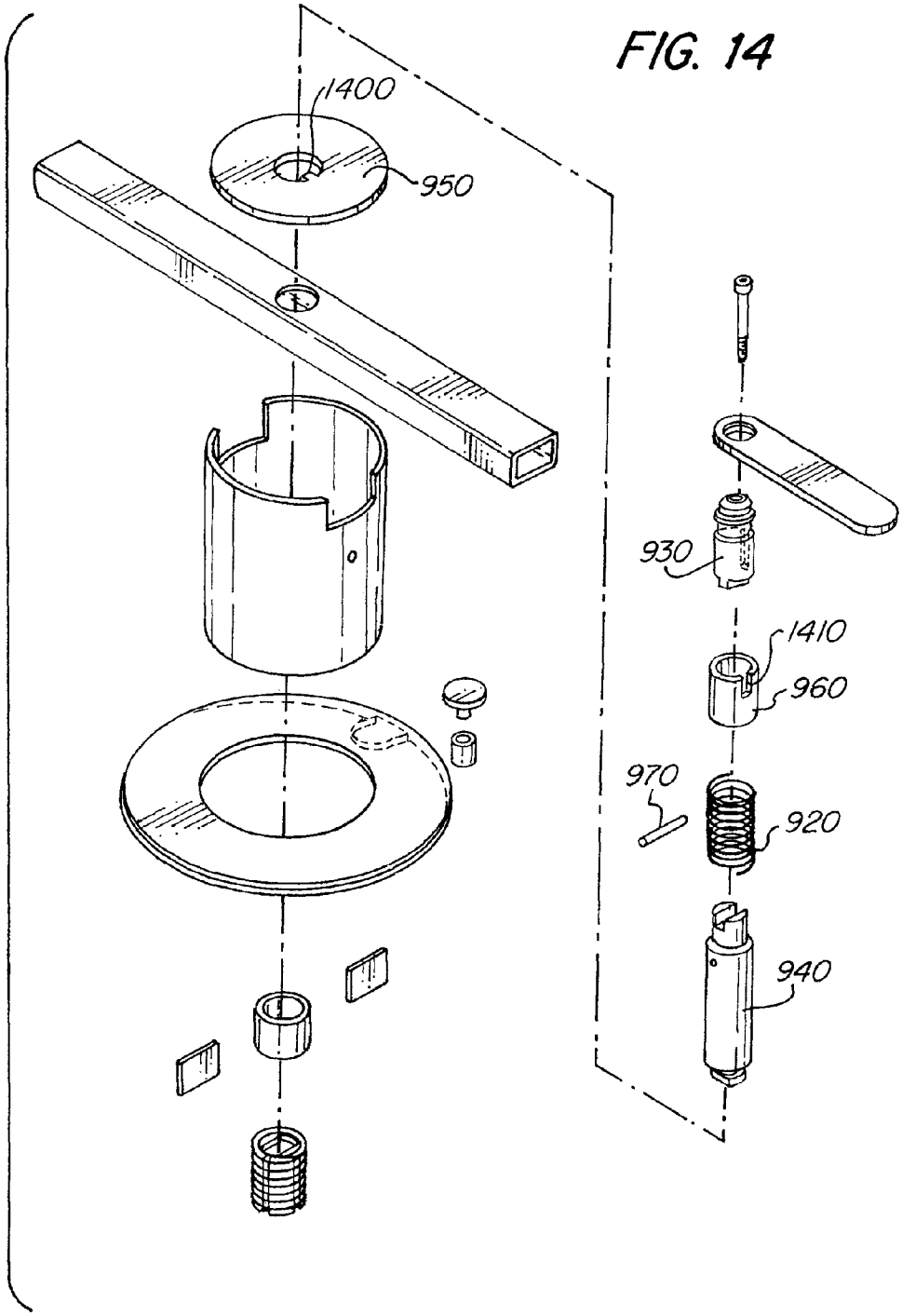
FIG. 14 is an isometric disassembled view of one embodiment of the pedestal and coupling device comprising a lockout mechanism for use in the system of FIG. 1.

FIG. 14 shows an embodiment of the coupling hardware on seat 120. In this embodiment a lockout system prevents the coupling mechanism from rotating unless rotating bolt 500 is fully extended from pedestal 160. In this embodiment, pedestal cover plate 950 comprises lock tab 1400 protruding into its center bore. Upper guide 960 comprises guide notch 1410 to provide clearance for lock tab 1400.

Figure 15:
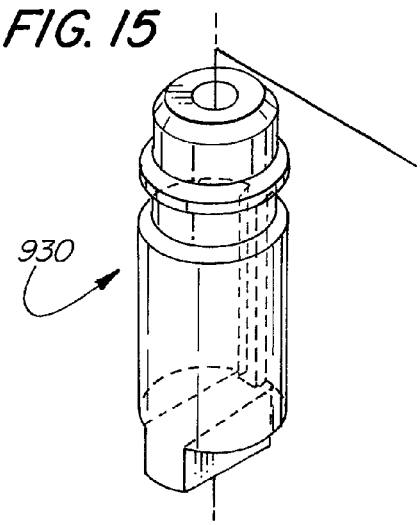
FIG. 15 is a blown up isometric view of the upper linkage for the coupling device shown in FIG. 14.
Figure 16:
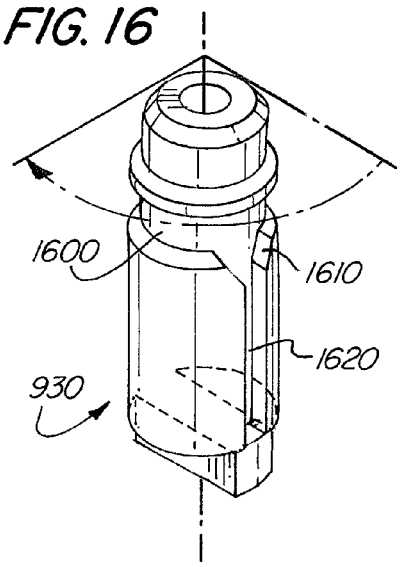
FIG. 16 is a blown up isometric view of the upper linkage shown in FIG. 15, rotated 90 degrees.

FIGS. 15 and 16 show upper linkage 930 from the embodiment with a lockout system. In this embodiment, upper linkage 930 comprises a linkage annular groove 1600, a lock slot 1620, and lock cams 1610 on either side of lock slot 1620.

Figure 17:
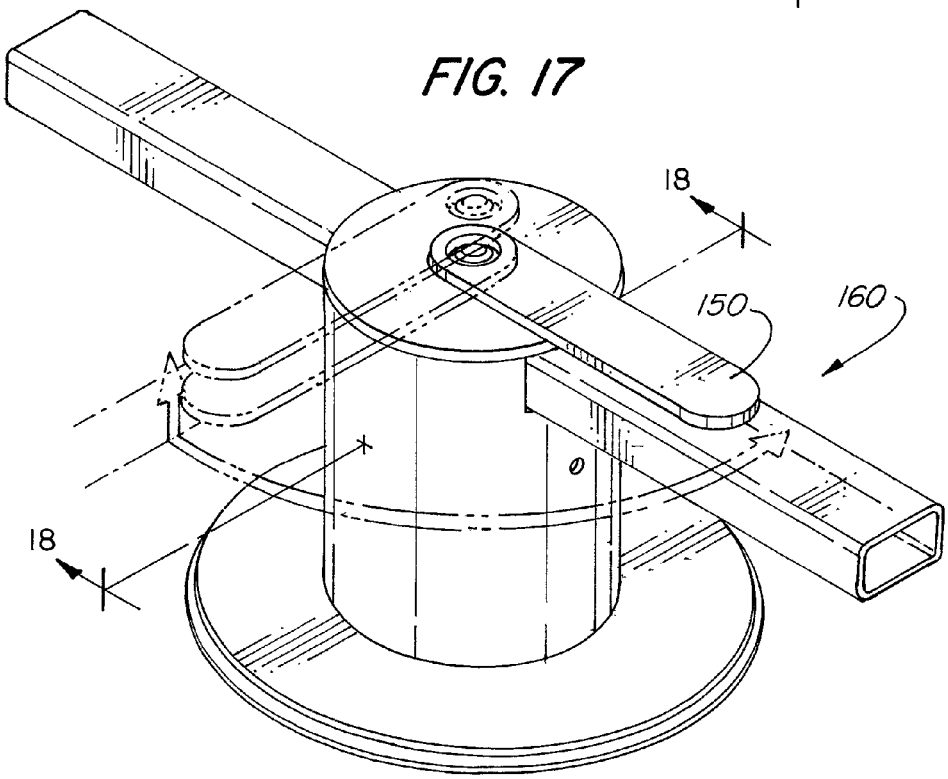
FIG. 17 is an isometric view of the pedestal of the chair with the lockout coupling device from FIG. 14 showing the possible positions of the selector.

FIG. 17 shows the operation of the coupling device in this embodiment. As can be seen in FIG. 17, selector 150 and the rest of the coupling device can only be lifted (withdrawing rotating bolt 500) when selector 150 is in a dismounted or resting, forward position.

Figure 18:
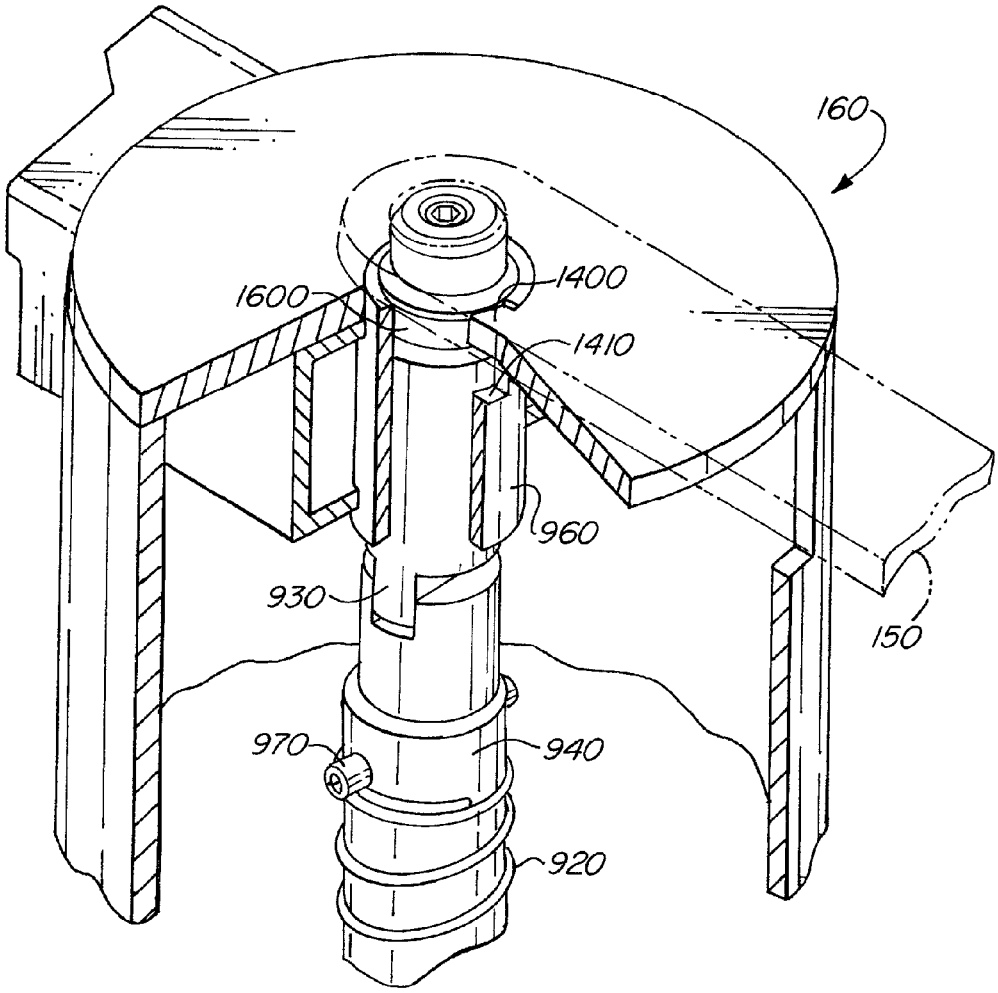
FIG. 18 is a blown up and partially exposed isometric view of the pedestal for use in the system in FIG. 1 comprising the lockout coupling device from FIG. 14 and the selector in a lower, sideways, and unlocked configuration.

FIG. 18 shows the internal workings of the coupling device in the embodiment with the lockout system. In FIG. 18, the coupling device is in a mounted configuration corresponding to selector 150 being in a sideways position. In this configuration, lock tab 1400 is disposed in linkage annular groove 1600. Selector 150, upper linkage 930, and the coupling device as a whole are free to rotate with lock tab 1400 in annular groove 1600. The coupling device is held in the lower position (corresponding to the coupling device and rotating bolt 500 being extracted from the bottom of pedestal 160) by annular groove 1600 and lock tab 1400. In this position, the coupling device and selector 150 are in an unlocked configuration because they are free to rotate.

Figure 19:
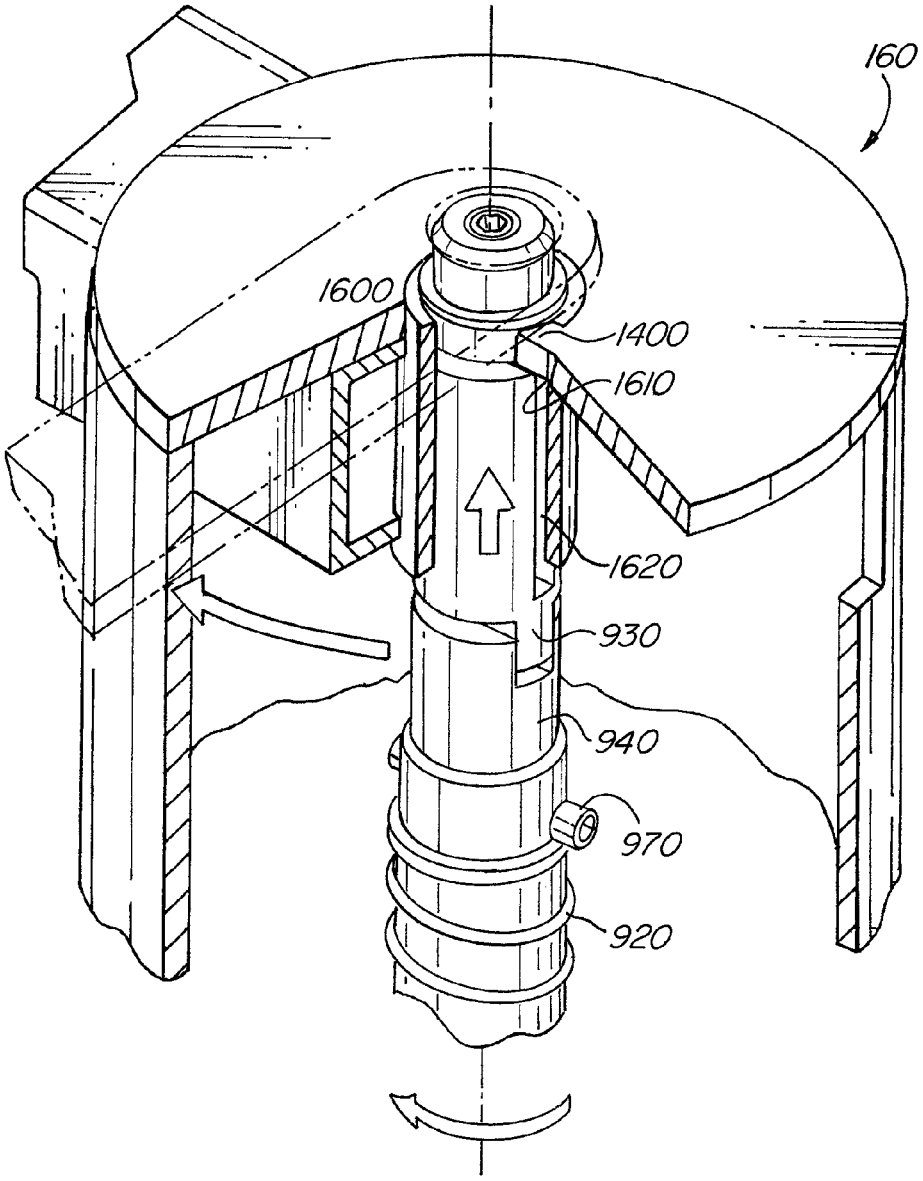
FIG. 19 is a blown up and partially exposed isometric view of the pedestal for use in the system in FIG. 1 comprising the lockout coupling device from FIG. 14 and the selector in a lower, partially forward, and partially locked configuration.
Figure 20:
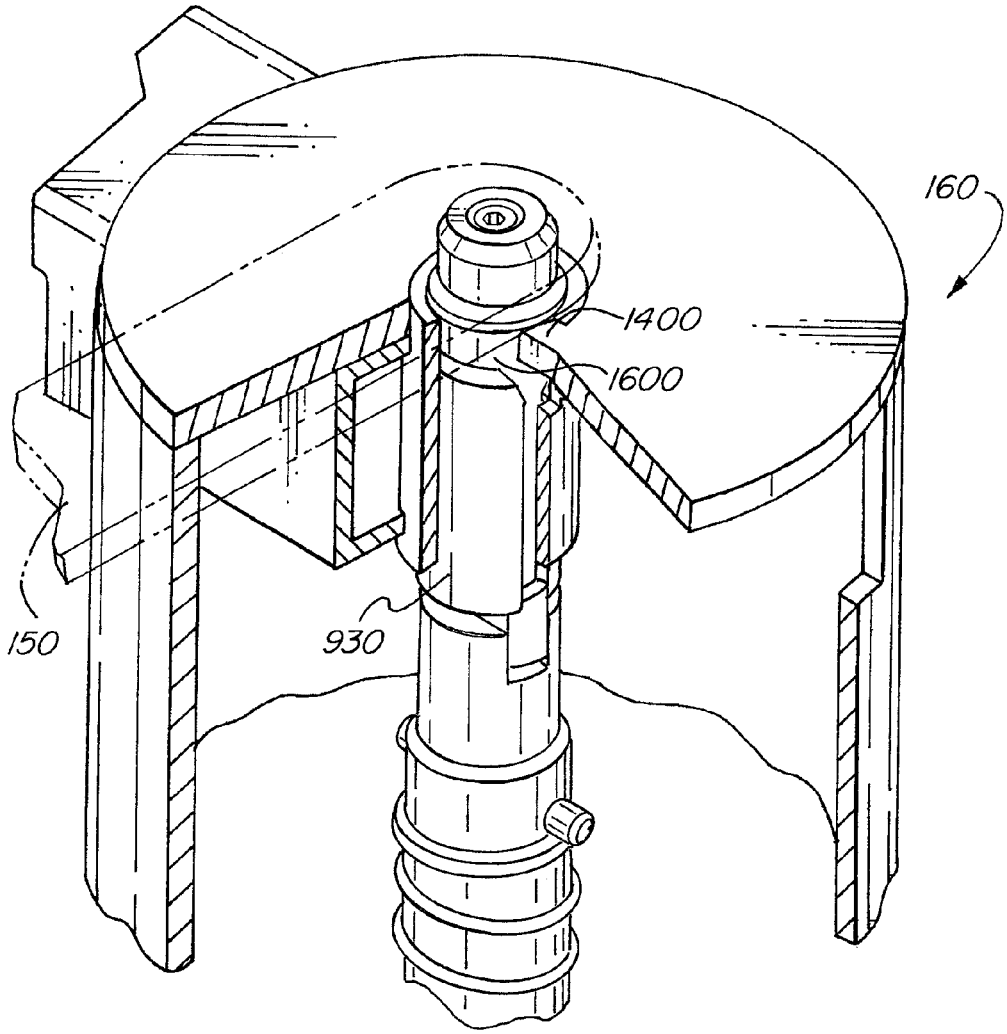
FIG. 20 is a blown up and partially exposed isometric view of the pedestal for use in the system in FIG. 1 comprising the lockout coupling device from FIG. 14 and the selector in a lower, partially forward, and partially locked configuration.

In FIGS. 19 and 20, selector 150 has been rotated approximately 85 degrees forward. In this position, lock tab 1400 is beginning to engage lock cam 1610 on upper linkage 930. Lock cam 1610 allows for upper displacement of the coupling device. Retractor spring 920 forces the coupling mechanism upward as lock tab 1400 slides against lock cam 1610. In this position, the coupling device and selector 150 are in partially locked configuration because although they are free to rotate, rotating away from lock slot 1620 requires overcoming resistance.

Figure 21:
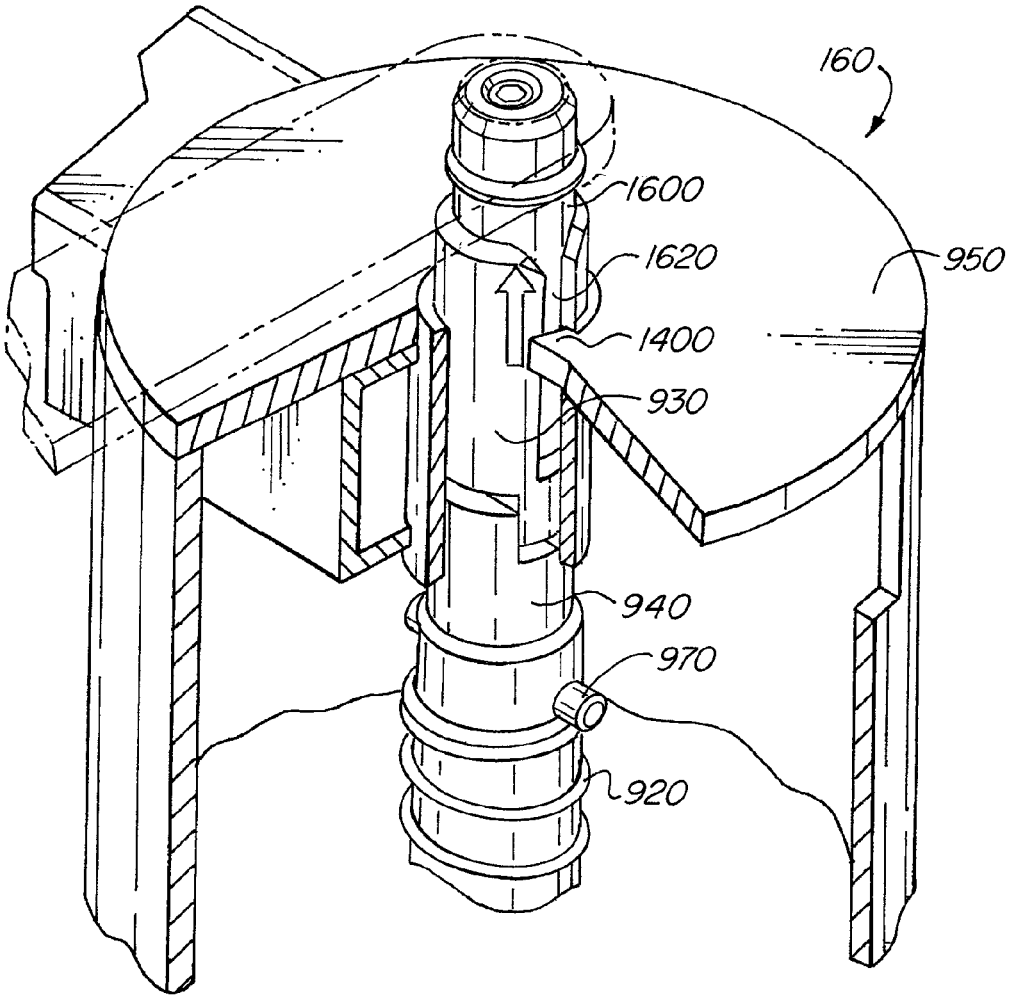
FIG. 21 is a blown up and partially exposed isometric view of the pedestal for use in the system in FIG. 1 comprising the lockout coupling device from FIG. 14 and the selector in an upper, forward, and locked configuration.

In FIG. 21, selector 150 is facing fully forward (or 90 degrees forward). In this position, lock tab 1400 is no longer engaging lock cams 1610. Lock tab 1400 is free to move up and down lock slot 1620 when selector 150 is in this position. Normally, retractor spring 920 forces the coupling device into an upward position. However, a user can push downward to override retractor spring 920 and bring lock tab 1400 into linkage annular groove 1600. When lock tab 1400 is in lock slot 1620, it prevents the coupling device or selector 150 from rotating. In this position, the coupling device and selector 150 are in a locked configuration because they can not rotate.

In embodiments without the lockout hardware, a user could mistakenly rotate selector 150 to the sideways (mounted) position while rotating bolt 500 is within pedestal 160 (with the coupling device in an upper position). This is possible because retractor spring 920 causes rotating bolt 500 to normally be withdrawn from mounting receptacle 300. The result a potentially unsafe condition where seat 120 and selector 150 appear mounted to floor 110 while actually only resting over mounting receptacle 300. A patron could attempt to sit on seat 120 in this condition and fall over.

In embodiments with the lockout hardware, as shown in FIGS. 14-21, this unsafe situation is less likely to occur. In those embodiments, in order to mount this seat 120 onto floor 110, a user must place rotating bolt 500 over mounting receptacle 300, fully depress selector 150 against the force of retractor spring 920 (thereby fully inserting rotating bolt 500 into mounting receptacle), and rotate selector 150 (thereby engaging rotating bolt 500 against mounting face 540). As discussed above, lock tab 1400 must be disposed within annular groove 1600 to facilitate selector rotation—and it can only be in annular groove 1600 when the coupling mechanism is fully depressed. A user cannot rotate selector 150 when it is an upper position, and the coupling device will automatically assume the upper position because of retractor spring 920. Thus, it is impossible for a user to rotate selector 150 into a sideways position, without extracting rotating bolt 500. If selector 150 is in a sideways position and rotating bolt 500 is protruding from the bottom of pedestal 160, seat 120 will not stand up properly unless it is properly mounted in mounting receptacle 300. The protruding rotating bolt 500 prevents the bottom of pedestal 160 from having a smooth, flat surface, which seat 120 needs to rest on floor 110. Therefore, whether or not selector 150 is rotated sideways, the user will have a visual indication of whether seat 120 is mounted properly. It is highly unlikely that a user would mistakenly fail to mount this embodiment of seat 120 to floor 110, or stand 320, without noticing.

The coupling systems described herein have the advantages of being robust and compact while allowing for height adjustment of the seats once installed. Having separate hardware for height adjustment and mounting facilitates a stronger mount, easy and precise height adjustment, and reliable height setting retention. Height adjustability allows seats 120 to be removed from a first location on floor 110 and reinstalled in a second location on floor 110. If seat 120's height is an improper height in the second location, a user can adjust the height. This may be necessary, for example, to make a row of reinstalled seats match in height. The system is further advantageous because seats 120 can be easily used and stored when removed; once seats 120 are placed on stands 320, they can be easily rolled or used as a conventional mobile chair. The systems are sufficiently robust to withstand safe use in a typical venue. Furthermore, the systems allow seats 120 to be easily removed from floors 110. A single user without the assistance of tools can remove one of the seats 120 in less than 15 seconds. Finally, the coupling systems are designed to prevent installer error and improve safety by giving visual and tactile feedback to an installer indicating whether the seats are mounted.

Although the invention has been described with reference to embodiments herein, those embodiments do not limit the scope of the invention. Modifications to those embodiments or different embodiments may fall within the scope of the invention.

What is claimed is:

1. A removable seating system, comprising:

a seating surface;

a support structure for supporting the seating surface above a base;

a bolt connected to the support structure;

a mounting receptacle located in the base;

a void in the mounting receptacle;

at least one stud in the mounting receptacle;

a sleeve disposed around the bolt;

at least one alignment slot in the sleeve that engages the at least one stud when the sleeve is inserted into the void; and the bolt rotates to a position where a portion thereof is directly underneath the at least one stud to couple the seating surface to the base.

2. The removable seating system of claim 1, wherein the sleeve comprises two alignment slots on opposite sides thereof and the mounting receptacle comprises two studs on opposite sides thereof;

the two alignment slots engage the two studs when the sleeve is inserted into the void; and the bolt rotates to a position where portions thereof are directly underneath both studs to couple the seating surface to the base.

3. The removable seating system of claim 1, wherein an inner surface of the void and an outer surface of the sleeve are dimensioned to allow the sleeve to be easily inserted into the void and fit snugly within the void.

4. The removable seating system of claim 3, wherein the inner surface of the void and the outer surface of the sleeve have a substantially circular cross-section.

5. A removable seating system, comprising:

a seating surface;

a support structure for supporting the seating surface above a base, the support structure having a lower surface;

a bolt connected to the support structure that is capable of retracting to a retracted position above or flush with the lower surface of the support structure and extending to an extended position below the lower surface of the support structure;

a mounting receptacle in the base that comprises a mounting plate having a mounting slot therein;

wherein the bolt inserts into the mounting slot in the extended position and subsequently rotates to a position where a portion thereof is directly underneath a portion of the mounting receptacle to couple the seating surface to the base.

6. The removable seating system of claim 5, wherein the bolt rotates to a position where more than one portion thereof is directly underneath more than one portion of the mounting receptacle to couple the seating surface to the base.

7. The removable seating system of claim 5, further comprising:

a spring that retracts the bolt above the lower surface of the support structure.

8. The removable seating system of claim 5, further comprising:

a base flange coupled to the support structure that abuts the base when the seating surface is mounted to the base.

9. The removable seating system of claim 8, further comprising:

an alignment marking on the base;

wherein the alignment marking is visibly aligned with the base flange when the seating surface is mounted to the base.

10. The removable seating system of claim 8, further comprising:

a receptacle cover; and a cover holder coupled to the base that holds the receptacle cover;

wherein the base flange is adapted to fit over the receptacle cover when the cover holder is holding the receptacle cover and the seating surface is mounted to the base.

11. The removable seating system of claim 8, wherein the base flange is dimensioned so as to be able to support the seat in a stable upright position on a smooth, level, horizontal surface.

12. The removable seating system of claim 5, further comprising:

a selector connected to the bolt that, when rotated, rotates the bolt.

13. The removable seating system of claim 5, further comprising:

a linkage that connects the bolt to the support structure; and a height adjuster that adjusts the length of the linkage.

14. The removable seating system of claim 5, further comprising:

a stand comprising a mounting receptacle, wheels, and a cover holder.

15. The removable seating system of claim 5, further comprising:

a lockout that prevents the bolt from rotating unless the bolt is extended below lower surface of the support structure.

16. The removable seating system of claim 5, wherein the mounting receptacle is located at least partially below an upper surface of the base.

17. The removable seating system of claim 16, wherein the mounting receptacle is located flush with the upper surface of the base.

18. The removable seating system of claim 5, wherein the bolt inserts into the mounting slot in the extended position and subsequently rotates to a position where a portion thereof is directly underneath a portion of the mounting plate to couple the seating surface to the base.

19. A method for installing a seat to a base, comprising:

(a) placing a support structure of the seat above and flush with an upper surface of the base;

(b) extending a single coupling device from a lower surface of the support structure;

(c) inserting the coupling device into a mounting receptacle located flush with the upper surface of the base without rotating the coupling device; and (d) engaging the mounting receptacle with the coupling device by rotating the coupling device without extending the coupling device.

20. The method of claim 19, further comprising:

(e) aligning the seat with an alignment marking on the base prior to step (c).

21. The method of claim 19, further comprising:

(e) removing a receptacle cover from the mounting receptacle prior to step (a).

22. The method of claim 21, further comprising:

(f) placing the receptacle cover in a cover holder located flush with the upper surface of the base prior to step (a).

23. The method of claim 22, wherein:

step (f) comprises placing the receptacle cover in the cover holder such that a portion of the receptacle cover is located above the upper surface of the base.

24. The method of claim 19, further comprising:

(e) adjusting the height of the seat after step (d).

25. The method of claim 19, further comprising:

(e) adjusting the tightness of the engagement between the mounting receptacle and the coupling device after step (d).

26. A method for removing a seat from a base, comprising:

(a) disengaging a single coupling device from a mounting receptacle located flush with an upper surface of the base by rotating the coupling device without retracting the coupling device;

(b) retracting the coupling device from the mounting receptacle without rotating the coupling device;

(c) retracting the coupling device into a lower surface of a support structure of the seat located above the upper surface of the base so that the coupling device is entirely above the upper surface of the base; and (d) removing the seat from the base.

27. The method of claim 26, further comprising:

(e) placing a receptacle cover in the mounting receptacle after step (d).

28. The method of claim 27, further comprising:

(f) removing the receptacle cover from a cover holder located flush with the upper surface of the base prior to step (e).

29. The method of claim 26, further comprising:

(e) placing the support structure of the seat above a mounting receptacle on a stand after step (d);

(f) extending the coupling device from the lower surface of the support structure;

(g) inserting the coupling device into the mounting receptacle on the stand; and (h) engaging the coupling device with the mounting receptacle on the stand.

30. The method of claim 29, further comprising:

(i) placing a receptacle cover in the mounting receptacle after step (d).

31. The method of claim 30, further comprising:

(j) removing the receptacle cover from a cover holder on the stand prior to step (i).

32. The method of claim 26, further comprising:

(e) sliding the lower surface of the support structure over the upper surface of the base prior to step (d).

33. The method of claim 26, further comprising:

(e) standing the seat in a stable upright position on the upper surface of the base prior to step (d).

* * * * *